US010174891B1

(12) United States Patent
Zheng et al.

(10) Patent No.: US 10,174,891 B1
(45) Date of Patent: Jan. 8, 2019

(54) SHALLOW DESIGN OF LED ILLUMINATING DOWNLIGHT DEVICES IN CEILINGS

(71) Applicant: PreciseLED, Inc., Valley Stream, NY (US)

(72) Inventors: Hao Zheng, Flushing, NY (US); Daniel Machlis, Far Rockaway, NY (US); Avraham Harris, Far Rockaway, NY (US); Pengfei Wang, Stamford, CT (US)

(73) Assignee: PreciseLED, Inc., Valley Stream, NY (US)

( * ) Notice: Subject to any disclaimer, the term of this patent is extended or adjusted under 35 U.S.C. 154(b) by 0 days.

(21) Appl. No.: 15/919,543

(22) Filed: Mar. 13, 2018

(51) Int. Cl.

| | |
|---|---|
| ***F21V 17/00*** | (2006.01) |
| ***F21S 8/02*** | (2006.01) |
| ***F21V 29/77*** | (2015.01) |
| ***F21V 17/02*** | (2006.01) |
| ***F21V 23/00*** | (2015.01) |
| ***F21V 29/51*** | (2015.01) |
| ***F21V 17/12*** | (2006.01) |
| ***F21V 29/89*** | (2015.01) |
| *F21Y 115/10* | (2016.01) |

(52) U.S. Cl.
CPC ..... *F21S 8/026* (2013.01); *F21V 17/02* (2013.01); *F21V 17/12* (2013.01); *F21V 23/001* (2013.01); *F21V 23/003* (2013.01); *F21V 29/51* (2015.01); *F21V 29/77* (2015.01); *F21V 29/89* (2015.01); *F21Y 2115/10* (2016.08)

(58) Field of Classification Search
None
See application file for complete search history.

(56) References Cited

U.S. PATENT DOCUMENTS

2014/0268801 A1* 9/2014 Madden ..... F21S 8/026 362/294
2015/0252988 A1* 9/2015 Rashidi Doust ..... F21V 21/049 362/285
2016/0330419 A1* 11/2016 Lin ..... H04N 9/3144

* cited by examiner

*Primary Examiner* — Vip Patel
(74) *Attorney, Agent, or Firm* — Shifrin Patent Law; Dan Shifrin

(57) ABSTRACT

A recessed, adjustable LED downlight is provided for shallow plenum installations. The fixture comprises a bottom plate, a circular base rotatable along an upper surface of the bottom plate, a heat sink enclosure secured to the upper surface of, and rotatable with, the circular base, and a bridge. The heat sink enclosure comprises a pair of fins on first opposite sides of the light source enclosure and a pair of tracks formed in second opposite sides of the heat sink enclosure between the pair of fins. The bridge, to which an LED module is secured, is affixed to the heat sink enclosure, whereby heat from the LED module is transferred to, and dissipated by, the bridge. The bridge is engaged with and pivotable along the pair of tracks in the heat sink enclosure.

14 Claims, 8 Drawing Sheets

SHALLOW DESIGN OF LED ILLUMINATING DOWNLIGHT DEVICES IN CEILINGS

RELATED APPLICATION DATA

The present application is related to commonly-owned and co-pending U.S. Design Application Ser. No. 29/557,865, entitled WALL INSTALLATION SUPPORT FOR LED STRIP LIGHTING, filed on Mar. 14, 2016, and to commonly-owned and co-pending Application Serial Number PCT/US16/51557, entitled RECESSED SUPPORTING DEVICE FOR INSTALLATION OF LED ILLUMINATING DEVICES IN WALLS AND CEILINGS, filed on Sep. 13, 2016, which applications are incorporated herein by reference in their entireties.

FIELD OF THE INVENTION

This invention relates to the field of lighting, and more particularly, the field of in-ceiling LED-based lighting.

BACKGROUND OF THE INVENTION

There are many kinds of lighting apparatuses. Many of the most recent ones consist of light emitting diodes (LEDs) as light sources. LEDs are individual light sources, that, when placed in an appropriate housing, can illuminate a space as a recessed "downlight". Downlights are desirable in both offices and homes and are used as a primarily light source in many applications. Typically, downlights contain both an LED light source and a driver, which is used to provide the proper current/voltage to the LED.

Some downlights are made to be adjustable, which allows the light source to be pointed in a particular direction other than directly downward. Potential uses for this are to highlight a wall or to point downward when the fixture is mounted on a sloped ceiling. Typically, adjustable downlights offer a horizontal rotation of approximately 360 degrees and a vertical pivot of 30-40 degrees. The 360 degree rotation is sometimes achieved by rotating on the horizontal axis just 180 degrees and pivoting the LED 30-40 degrees in both directions, which gives the fixture the full desired adjustability.

Part of a good downlight design includes the ability to easily service the LEDs and drivers. As drivers and eventually LED's can have issues and need servicing, access to both of these are a critical part of a good downlight design.

One recent change in the industry is that plenums (the space between the structural ceiling and the drop down ceiling, which is usually sheetrock) are getting smaller. Perhaps due to the increasing cost of real estate and/or the desirability of increased room heights, less and less space is being allotted to the plenum.

In the past, downlights, especially IC rated (which can be surrounded by insulation, as opposed to non-IC rated fixtures, which require a void of 3" around the fixture to operate safely) have been as tall as 8" or more. But due to the recent change in customer demand, manufacturers of downlights have recently adapted by offering shallow downlights with heights of, for example, 4 inches or less. It should be noted that there is no technical or conventional definition of a "shallow" downlight vs. a non-shallow downlight; in other words, there is no authority that defines a shallow downlight as being, for example, less than 4 inches in height.

There are several design challenges in making a shallow downlight. Generally speaking, a fixture is considered aesthetically pleasing for modern lighting designers if it has a regressed lens. That is, the lens that diffuses the light is preferred to be not at the surface of the lower ceiling but rather regressed into the ceiling. The exact placement is likely a matter of taste, but industry standard seems to be around 1 inch regressed, which is provided by a "trim", which has a regressed horizontal lens (made of solite, glass, or other similar material), diagonal beveled aluminum sides, and, if it is a "flanged" trim, a horizontal flange beneath the ceiling of varying widths (depending on the manufacturer). This desired ~1 inch space of regression can be offset somewhat by the thickness of the drywall itself, which typically can range from ½" to 1".

In addition, some diffusion and beam spreading is required to allow for the light to look aesthetically pleasing to those in the lighted space. A distance (the exact measurement depends on various factors such as the LED source type), is required for the light to diffuse before striking the lens. Also, depending on the application, lighting designers may want a wide beam or narrow beam spread or somewhat in between, which is provided by a beam spread lens or reflector. This prevents the LED light source from being directly above the lens of the trim, but rather regressed even further into the fixture.

A heat sink is needed to dissipate the heat of the LED source or the fixture will get too hot, failing safety tests. Typically, heat sinks are crafted from aluminum and are mounted to the rear of the LED source. In a shallow downlight, there is little room to place a heat sink above the LED. Putting the heat sink to the sides of the LED source, while making sense logistically, is not optimal for thermal distribution using conduction alone, because not enough heat will be drawn from the LED sideways. There would also be a dramatic delta between the heat level of the aluminum closest to the LED and that of the aluminum on the outer edges of the heat sink, which is considered non-optimal in terms of proper heat sink design, regardless of the temperature.

Even if a heat sink is designed that surrounds the main LED source and draws the heat away properly, a novel design for incorporating the driver would need to be created. In a typical downlight design with the heat sink above the LED source, there is usually enough space to the sides of the LED module for an electrician's hand to fit through to allow for driver servicing. But if the entire heat sink mechanism is surrounding the LED source on the horizontal plane, servicing a driver that is located outside of the mechanism would be difficult, because the mechanism would either have to be removed or have an opening, which would reduce the heat sinking properties. And, if the driver was located on the rotating mechanism, a novel approach would have to be taken to avoid the building's line wire from rotating along with the mechanism. Moving line wires coming from the building can cause potential problems as the conduit may not be as flexible as needed by the fixture to do the rotation. Especially where there is limited plenum space, the conduit's flexibility may also be limited by the distance to structural ceiling.

If a fixture is designed that had an LED pivoting on one axis and another mechanism (such as a heat sink) rotating on another axis, there would need to be a limited number of parts involved in the transfer of heat. Each additional part creates another point of thermal conduction; each point of thermal conduction creates a substantial loss of thermal conductivity.

Creating a shallow housing downlight that is adjustable is even more difficult than a static downward-facing downlight, as the mechanisms for the approximately 360 degree rotation and the 40 degree pivot both need to be operate within the limited space.

Some of the leading manufacturers of downlights have offered shallow housing for non-adjustable applications, as shallow as 2" depth, using custom designed aluminum heat sinks that move the heat away from directly above the LED source. But, shallow adjustable downlights are scant in today's market and those that exist are currently 3.5" or taller.

SUMMARY OF THE INVENTION

Embodiments of the present invention provide a recessed LED lighting fixture for shallow plenum installations. The fixture comprises a bottom plate, a circular base rotatable along an upper surface of the bottom plate, a heat sink enclosure secured to the upper surface of, and rotatable with, the circular base, and a bridge. The heat sink enclosure comprises a pair of fins on first opposite sides of the light source enclosure and a pair of tracks formed in second opposite sides of the heat sink enclosure between the pair of fins. The bridge, to which an LED module is secured, pivots approximately 30 degrees in one direction and is affixed to the heat sink enclosure, whereby heat from the LED module is transferred to, and dissipated by, the bridge. The bridge is engaged with and pivotable along the pair of tracks in the heat sink enclosure.

DETAILED DESCRIPTION OF THE PREFERRED EMBODIMENT

Figure 1:
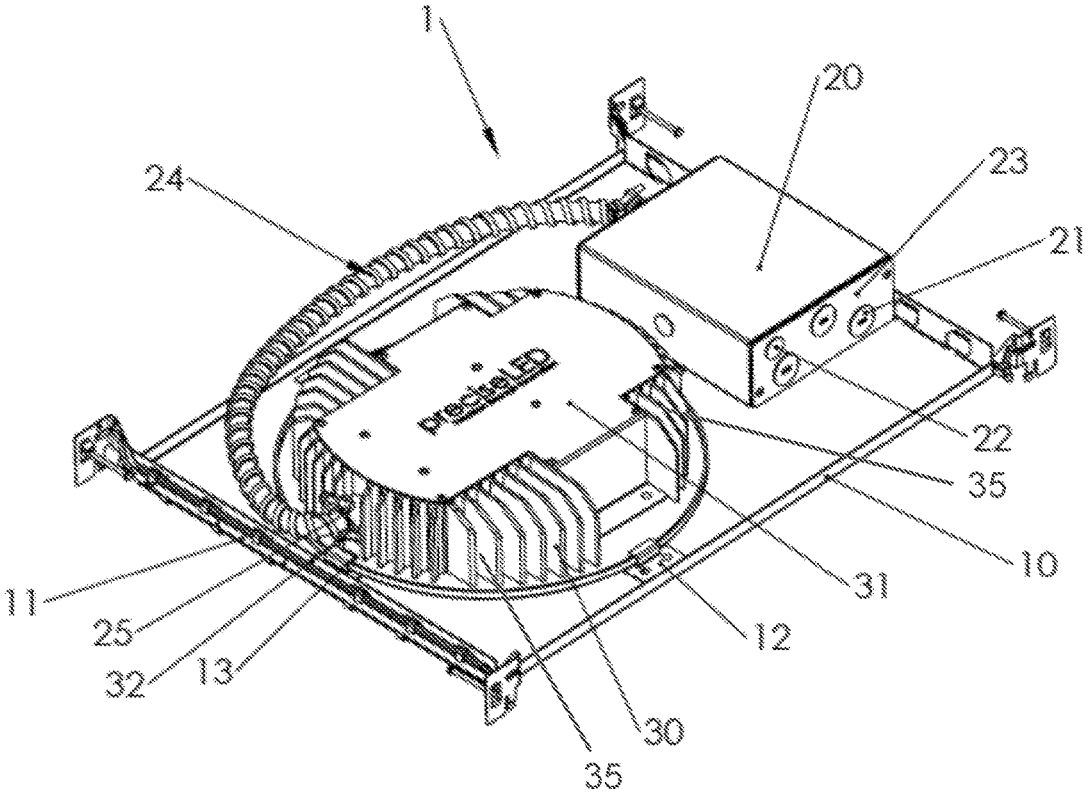
FIG. 1 is a perspective view from the top of a light fixture constructed in accordance with exemplary embodiments of the present invention.

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Embodiments of the present invention provide an adjustable LED downlight for use as illuminating devices in shallow plenums. The device comprises of a main, rotatable section which includes an LED light source and a driver. The mechanism is rotatable up to a maximum less than 360 degrees. A three-sided (one horizontal, two vertical) "bridge" containing the LED chip pivots 30 about degrees in one direction. The pivot is optimized by utilizing points on two different circle circumferences. The circumferences are drawn using a four-bar linkage based design, with the centers of each circle being extrapolated by the LED source being "placed" on the circumference in both the downward facing position and in the most pivoted 30 degree position. The design prevents the bridge from rising too high as it rotates, and all positions remain close to the surface of the ceiling so light loss is minimized.

The bridge uses heat pipes which draw the heat away from the LED and make the vertical edges of the bridge a heat center, which then transfers to the surrounding rotating heat sink. To minimize heat loss, the downlight includes only two conduction points: one behind the LED diode itself and one where the heat pipe bridge meets the sides of the rotating heat sink. At both of these points there are graphite pads or thermal grease to eliminate microscopic gaps that inhibit heat conduction. The two points of conduction are made possible by the rotating heat sink mechanism, which contains an arced path across which the bridge can pivot.

The bridge may be set to standard pivot intervals of 5 degrees and locked into place using a clamp or similar method to ensure tight conduction.

The rotating heat sink mechanism includes a platform to hold the driver. The driver is serviced by pivoting the heat pipe bridge to the 30 degree angled position. The placement of the driver on the rotating heat sink contrasts with conventional drivers, which are mounted in an external, non-rotating area.

In order to avoid having the line wire (often encapsulated in BX casing) becoming tangled in the ceiling while trying to rotate along with the downlight, a separate junction box is provided in which the electrical connection is made between the line wires and the fixture. With this, the line wire remains static no matter the rotation of the fixture, while a separate set of wires rotate with the downlight.

Figure 6:
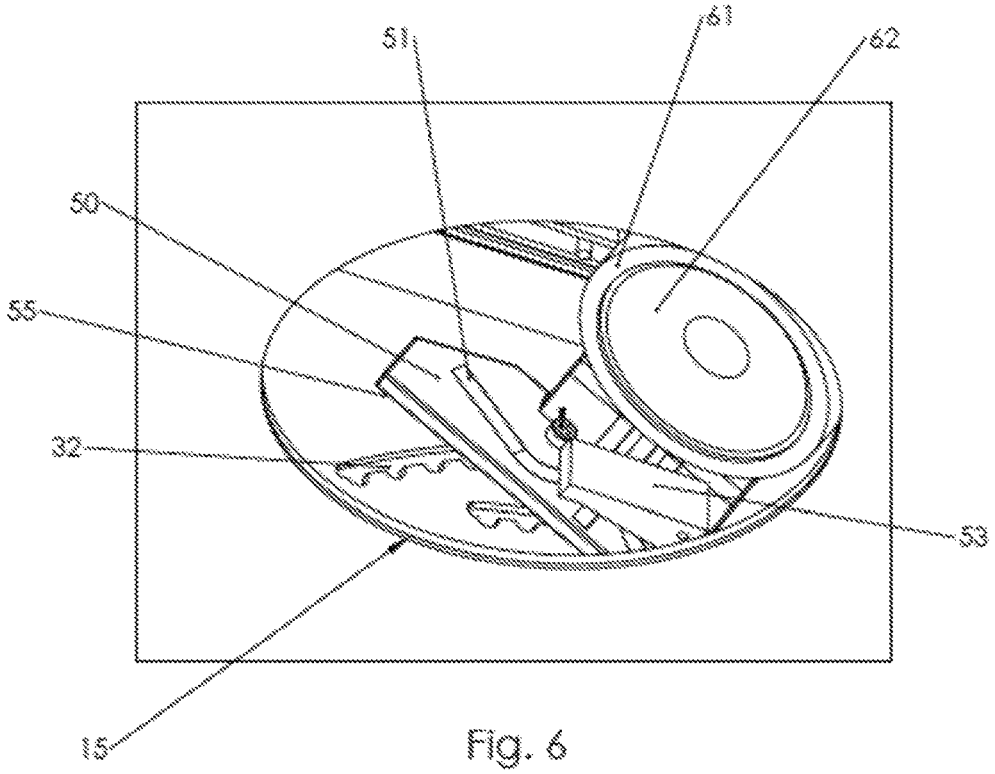
FIG. 6 is a bottom view of the light fixture of FIG. 1 showing the light fixture pivoted to a 30 degree angle position.
Figure 10:
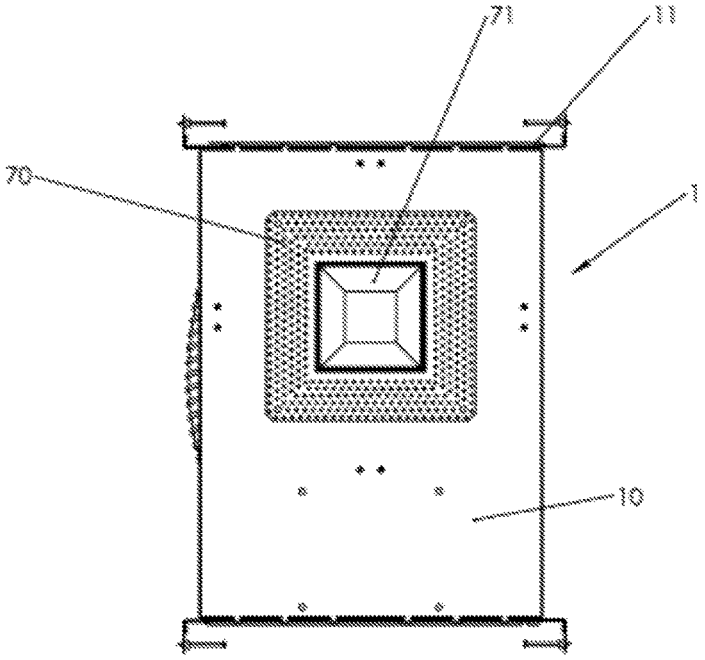
FIG. 10 is a bottom view of the light fixture of FIG. 1 showing square flangeless trim attached to the light fixture.
Figure 11:
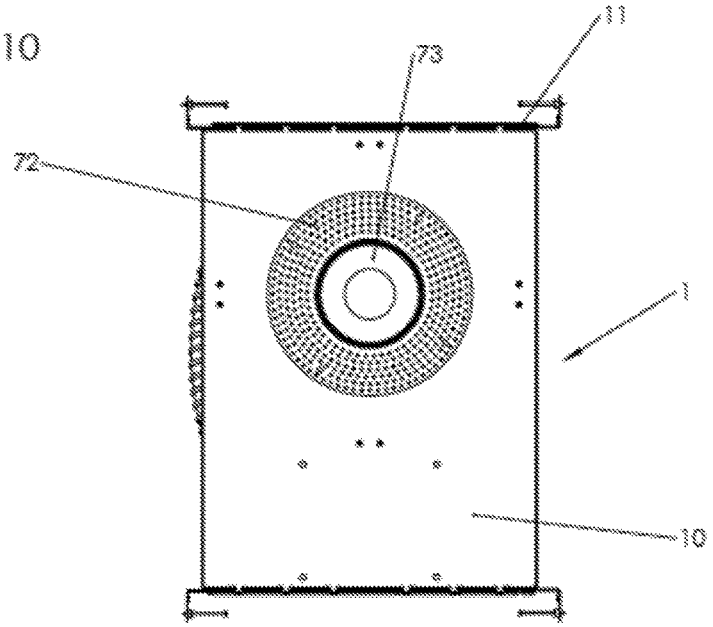
FIG. 11 is a bottom view of the light fixture of FIG. 1 showing round flangeless trim attached to the light fixture.
Figure 12:
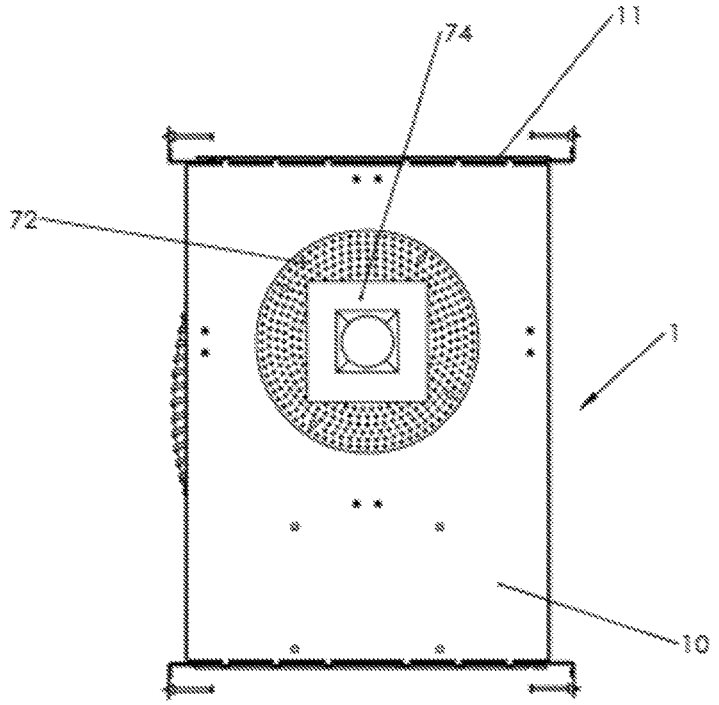
FIG. 12 is a bottom view of the light fixture of FIG. 1 showing square flange trim attached to the light fixture.
Figure 13:
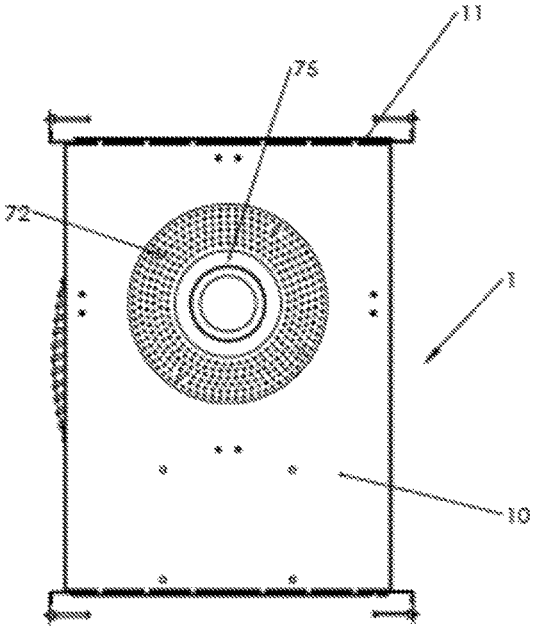
FIG. 13 is a bottom view of the light fixture of FIG. 1 showing round flange trim attached to light fixture.

More specifically, embodiments of the device of the present invention provide a recessed light fixture 1 (FIG. 1) which acts as an adjustable LED downlight for installation in shallow plenum. The fixture 1 is comprised of a galvanized steel bottom plate 10, a heat sink enclosure 30, a bridge 50 (FIG. 2) on which an LED module 60 with an LED 63 (FIG. 4) is secured and that also contains heat pipes 51 and a copper base 52 (FIG. 6). A junction box 20 allows for connection of the device 1 to line voltage. The bottom plate 10 contains mounting bars 11 for installing the device 1 into ceiling studs. Flexible BX wires 24 connect the junction 20 box to an LED driver 40, which is also secured to the heat sink enclosure 30. For the trim, a square 70 (FIG. 10) or round 72 (FIG. 12) adapter converts the fixture 1 for either a square 71 (FIG. 10) or round 73 (FIG. 11) "flangeless" trim, or a round 75 (FIG. 13) or square 74 (FIG. 12) flanged trim.

Figure 2:
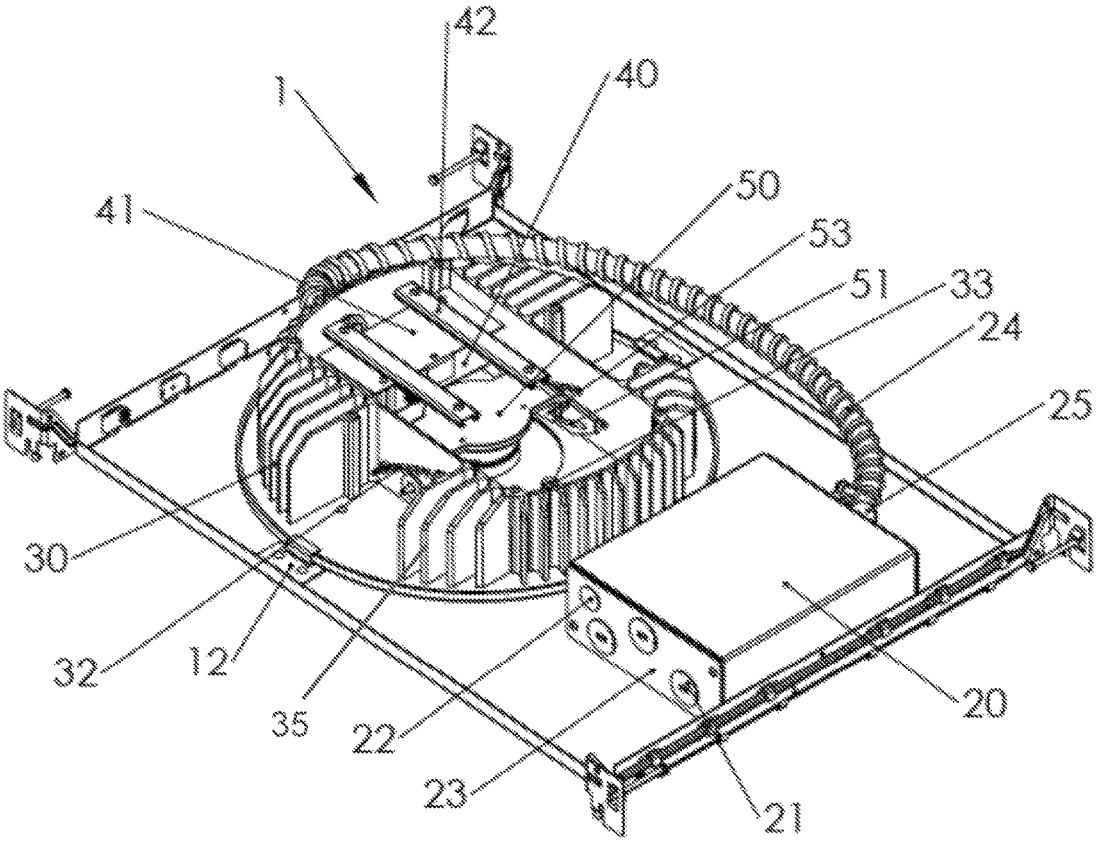
FIG. 2 is another perspective view from the top of the light fixture of FIG. 1.

Referring to FIGS. 1 and 2, preferable embodiments of the light fixture 1 employ an aluminum heat sink enclosure 30. The base of the heat sink enclosure 30 is rests on the upper surface of the bottom plate 10 and is secured to the bottom plate 10 with one or more a mounting clips 12, which allow the heat sink enclosure 30 to rotate, preferably to a maximum of less than 360 degrees. The bottom plate 10 employs a mounting clip 13 that limits the heat sink enclosure 30 rotation to less than 360 degrees. The heat sink enclosure 30 also employs a locking thumb screw 33 to keep the enclosure 30 from rotating during installation of the light fixture 1. Fins 35 on opposite sides of the heat sink enclosure 30 transfer heat from the heat pipe bridge 50 into the surrounding ambient environment. Structures other than fins may also be used to transfer heat away from the heat pipe bridge 50. A sheet metal plate 31 forms the top of the heat sink enclosure 30. Pivoting groove tracks 32 of the heat sink enclosure 30 between the fins 35 allow the bridge 50 to pivot from a horizontal position to a 30 degree angled position.

Preferable embodiments of the light fixture employ a flexible BX or other power cable 24 designed to electrically connect a power connection within the junction box 20 to the driver 40. The BX cable 24 is affixed to the heat sink enclosure 30 and the junction box 20 by BX wire connectors 25. The junction box 20 is affixed directly to the bottom plate 10. The junction box 20 employs two cover plates 23 that may include three ½" knockout holes 21 and one ⅜" knockout hole 22 (or any other configuration appropriate to the particular installation) for line voltage wiring service. It will be appreciated that the junction box 20 and other components may be provided in other configurations and materials and that the present invention is not limited to the representative embodiment described and illustrated herein.

Figure 3:
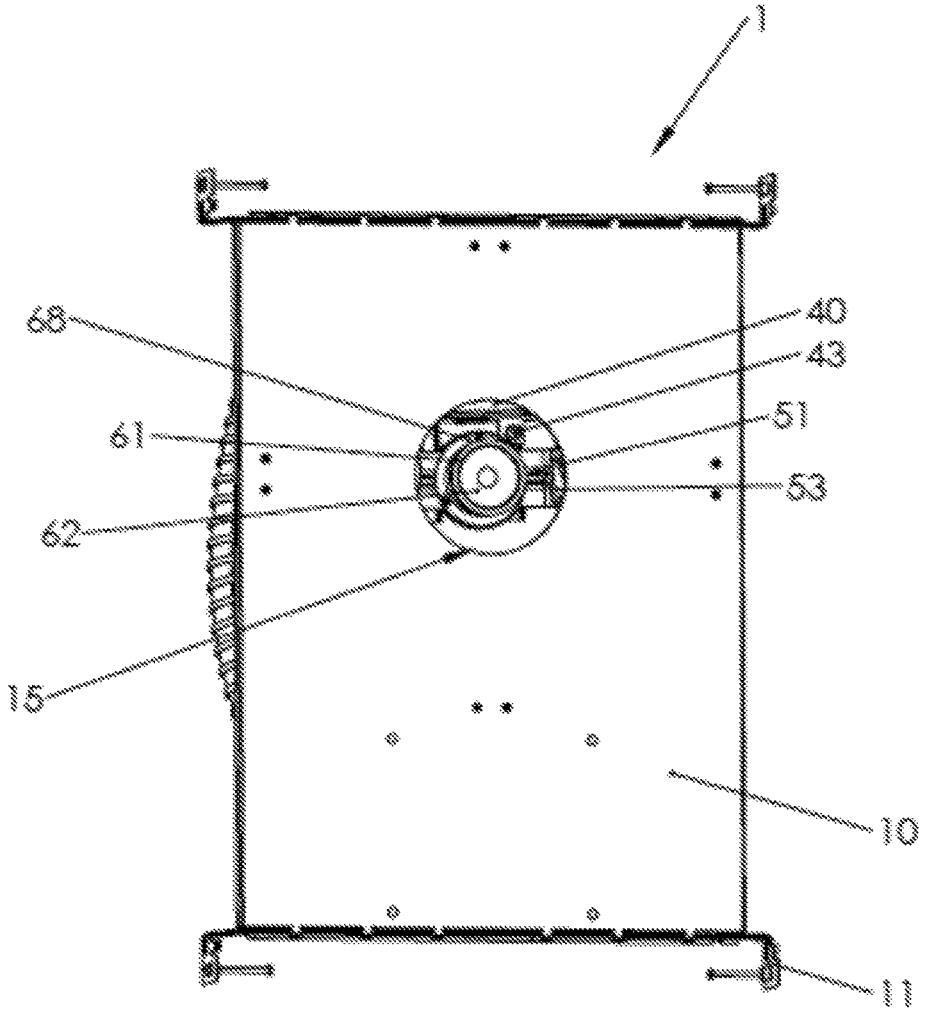
FIG. 3 is a bottom view of the light fixture of FIG. 1.

In FIG. 3, the light fixture 1 is shown in the operation position, with a view from below. In FIG. 6, the light fixture 1 is shown in the operation position viewed from below through the illumination aperture 15 with the aluminum bridge 50 being pivoted to a 30 degree angled position. The aluminum bridge 50 is pivoted to the 30 degree position by unlocking a lever 53. The pivoting movement is guided and controlled by the groove track 32.

Figure 4:
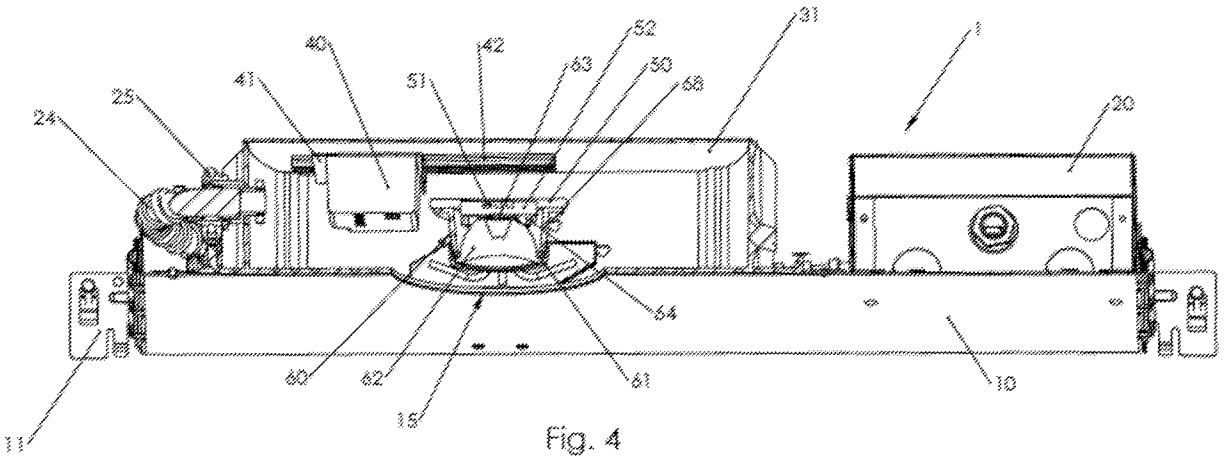
FIG. 4 is a cross-section side view of the light fixture of FIG. 1.
Figure 5:
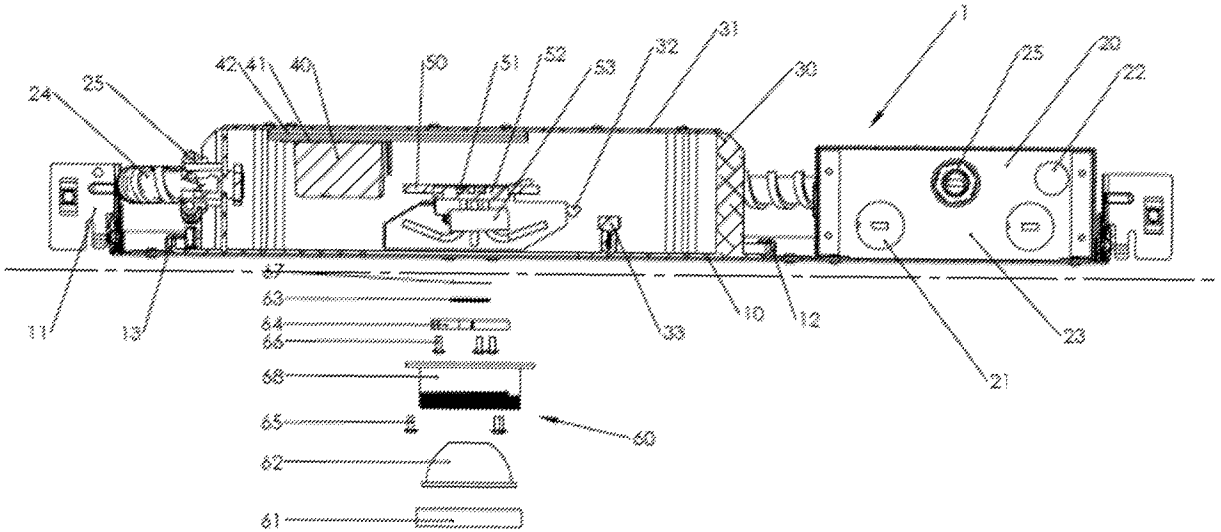
FIG. 5 is a exploded cross-section side view of the light fixture of FIG. 1.

FIG. 4. Is a cross-section side view of an embodiment of the light fixture 1 and FIG. 5 is an exploded cross-section side view of an embodiment of the light fixture 1. As shown, the LED module 60 preferably contains an optic holder 68, a beam spread optic 62, a screw-in cover 61, a COB solderless connector 64, a LED array 63, and a graphite thermal pad 67. The COB connector 64 and optic holder 68 are affixed to the aluminum bridge 50 preferably by screws 66 and 65. The embodiment of the light fixture 1 depicted in FIG. 4 shows the aluminum bridge 50 in the horizontal operation position. The aluminum bridge 50 contains three copper heat pipe 51, which are welded to the aluminum bridge 50 for better thermal conduction. The aluminum bridge 50 employs a graphite thermal pad 55 to improve the thermal conduction between the heat sink enclosure 30 and the aluminum bridge 50. In preferable embodiments, the LED driver 40 is affixed to a sheet metal mounting plate 41, which is affixed to the sliding track 42, allowing the horizontal movement of the driver 40 along the track 42. The sliding distance of the mounting plate 41 is limited by the sliding track 42. The sliding mechanism employs a thumb screw 43 locking mechanism to lock the LED driver 40 in place.

Figure 8:
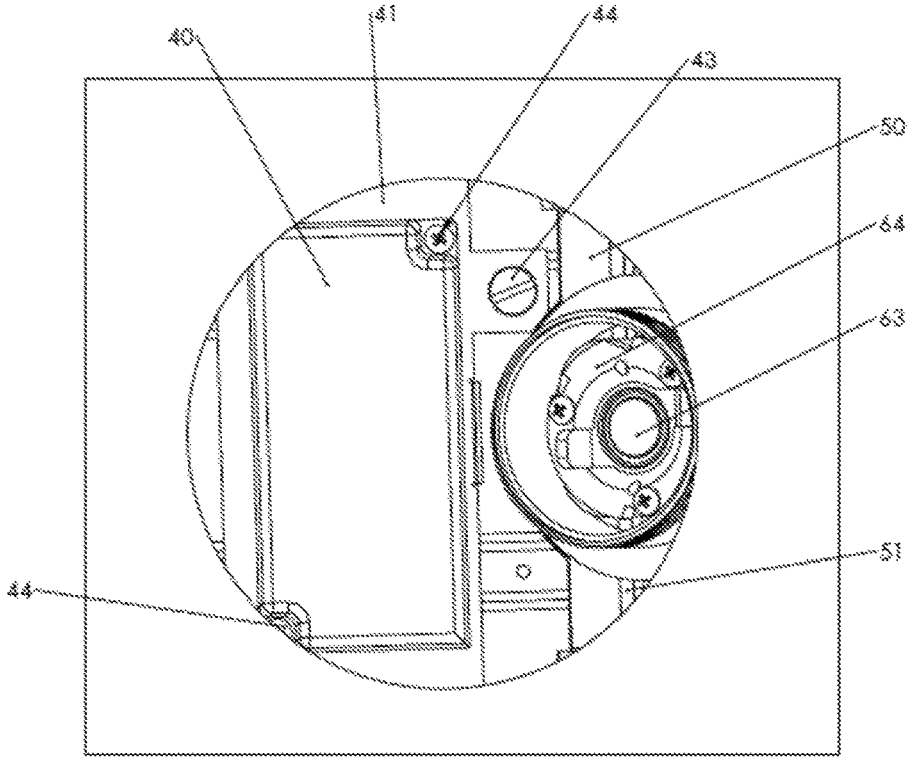
FIG. 8 is a bottom view of the light of FIG. 1 in the service position with the lighting driver slid to the illumination aperture.
Figure 7:
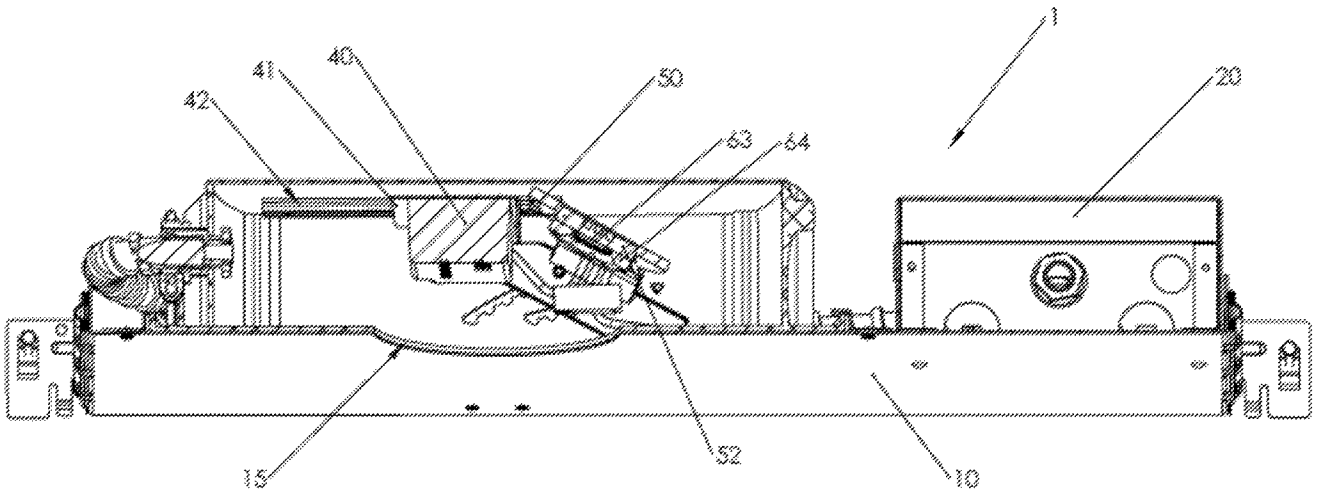
FIG. 7 is a cross-section view of the light fixture of FIG. 1 in the service position with the lighting driver slid to the illumination aperture.
Figure 9:
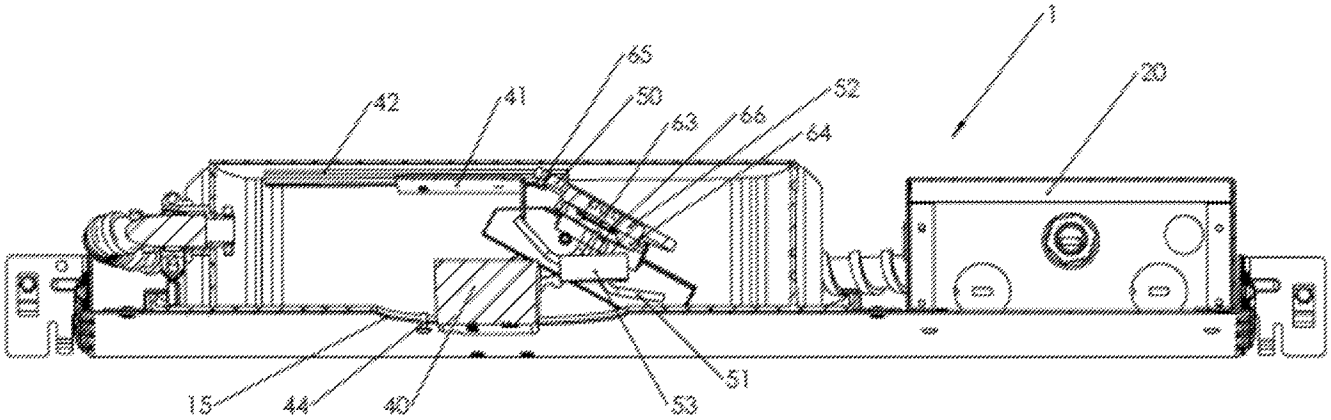
FIG. 9 is a cross-section view of the light fixture of FIG. 1 in the service position with the lighting driver having been removed through the illumination aperture.

Referring to FIG. 7, the light fixture 1 is depicted in the driver service position. In FIG. 7, the aluminum bridge 50 is pivoted to the 30 degree angled position. The LED driver 40 has been slid over the top of the illumination aperture 15 and is now accessible for complete removal by unscrewing the driver mounting screws 44. FIG. 8 is a bottom-up view of the light fixture 1 in the driver service position. In FIG. 9, the optic holder 68 and beam spread optic 62 of the LED module 60 have been removed to enable the removal of the LED driver 40. The LED driver 40 has been partially removed from the mounting plate 41 and is approaching the illumination aperture 15.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A recessed LED lighting fixture, comprising:

a bottom plate having a circular opening therethrough;

a circular base rotatable along an upper surface of the bottom plate and having a circular opening therethrough in alignment with the opening through the bottom plate;

a heat sink enclosure secured to the upper surface of, and rotatable with, the circular base, the heat sink enclosure comprising;

a pair of fins on first opposite sides of the light source enclosure; and a pair of tracks formed in second opposite sides of the heat sink enclosure between the pair of fins; and a bridge, to which an LED module is secured, affixed to the heat sink enclosure, whereby heat from the LED module is transferred to, and dissipated by, the bridge, the bridge engaged with and pivotable along the pair of tracks in the heat sink enclosure.

2. The lighting fixture of claim 1, further comprising a flexible power cable affixed at a first end to a junction box secured to the bottom plate and affixed at a second end to the heat sink enclosure, the power cable electrically coupled between a power connection within the junction box and an LED driver within the heat sink enclosure.

3. The lighting fixture of claim 1, wherein the circular base is rotatable around the bottom plate in an amount less than 360 degrees.

4. The lighting fixture of claim 1, wherein the bridge is pivotable along the pair of tracks approximately 30 degrees.

5. The lighting fixture of claim 1, wherein the bridge comprises a plurality of heat pipes.

6. The lighting fixture of claim 5, wherein the number of heat pipes is three.

7. The lighting fixture of claim 1, further comprising a graphite thermal pad between the heat sink enclosure and the bridge.

8. The lighting fixture of claim 1, further comprising an LED driver slidable within the heat sink enclosure and accessible when the bridge is pivoted along the pair of tracks.

9. A recessed LED lighting fixture, comprising:

a bottom plate;

a circular base rotatable along an upper surface of the bottom plate;

a heat sink enclosure secured to the upper surface of, and rotatable with, the circular base;

a bridge affixed to the heat sink enclosure and engaged with and pivotable along a pair of tracks in the heat sink enclosure;

an LED module having an LED light source in alignment with openings in the bottom plate and the circular base, the LED module secured to the bridge whereby heat from the LED module is transferred to, and dissipated by, the bridge; and an LED driver slidable within the heat sink enclosure and accessible when the bridge is pivoted along the pair of tracks.

10. The lighting fixture of claim 9, wherein the bridge comprises a plurality of heat pipes.

11. The lighting fixture of claim 9, further comprising a graphite thermal pad between the heat sink enclosure and the bridge.

12. The lighting fixture of claim 9, further comprising a flexible power cable affixed at a first end to a junction box secured to the bottom plate and affixed at a second end to the heat sink enclosure, the power cable electrically coupled between a power connection within the junction box and the LED driver.

13. The lighting fixture of claim 9, wherein the circular base is rotatable around the bottom plate in an amount less than 360 degrees.

14. The lighting fixture of claim 9, wherein the bridge is pivotable along the pair of tracks approximately 30 degrees.

* * * * *